US008910608B2

(12) United States Patent
Hironaka et al.

(10) Patent No.: US 8,910,608 B2
(45) Date of Patent: Dec. 16, 2014

(54) CYLINDER HEAD

(71) Applicant: Honda Motor Co., Ltd., Tokyo (JP)

(72) Inventors: Masaki Hironaka, Tochigi-ken (JP); Takeya Harada, Tochigi-ken (JP)

(73) Assignee: Honda Motor Co., Ltd., Tokyo (JP)

( * ) Notice: Subject to any disclaimer, the term of this patent is extended or adjusted under 35 U.S.C. 154(b) by 65 days.

(21) Appl. No.: 13/771,693

(22) Filed: Feb. 20, 2013

(65) Prior Publication Data

US 2013/0220265 A1 Aug. 29, 2013

(30) Foreign Application Priority Data

Feb. 28, 2012 (JP) ..... 2012-041297

(51) Int. Cl.
*F02F 1/42* (2006.01)
*F01L 1/00* (2006.01)

(52) U.S. Cl.
CPC *F02F 1/4271* (2013.01); *F01L 1/00* (2013.01)
USPC ..... 123/193.5; 60/320

(58) Field of Classification Search
CPC .... F02B 61/045; F02B 77/11; F01N 13/1805; F01N 13/10; F01N 13/102; F01N 13/08; F01N 13/1827; F01N 13/14; F01N 13/1838; F01N 2450/20; F01N 2510/02; F02F 1/4271
USPC ..... 123/193.5, 193.1; 60/320
See application file for complete search history.

(56) References Cited

U.S. PATENT DOCUMENTS

2008/0083216 A1* 4/2008 Claudinon ..... 60/320

FOREIGN PATENT DOCUMENTS

| | | |
|---|---|---|
| JP | S55-016126 | 4/1980 |
| JP | S57-026037 | 6/1982 |
| JP | S58-021092 | 4/1983 |

* cited by examiner

*Primary Examiner* — Noah Kamen
(74) *Attorney, Agent, or Firm* — Gregory J. Burke

(57) ABSTRACT

A cylinder head includes a combustion chamber recess on a lower surface, an exhaust port with downstream and upstream side channels, and downstream and upstream liners respectively inserted into the downstream and upstream side channels. The downstream side channel has an open end at a side surface of the cylinder head and an opposite end sealed by a bottom wall. The upstream side channel has an end open to the combustion chamber recess and an opposite end connected to a side portion of the downstream side channel. The downstream side liner includes a generally tubular member with a linear axis and has an insertion end abutting the bottom wall. The downstream side liner has a connecting hole in a side portion facing the upstream side channel and engaged by the upstream side liner, which also includes a generally tubular member.

20 Claims, 9 Drawing Sheets

CYLINDER HEAD

CROSS REFERENCE TO RELATED APPLICATIONS

The present application claims priority under 35 U.S.C. §119 to Japanese Patent Application No. 2012-041297, filed Feb. 28, 2012, entitled "Cylinder Head", which is hereby incorporated by reference in its entirety.

BACKGROUND

Some internal combustion engines for automobiles have a tubular liner attached to an exhaust port of a cylinder head so as to cover the inner surface thereof in order to provide high temperature exhaust gas to an exhaust purification device incorporated in the exhaust system. These internal combustion engines can have an air layer (gap) between the liner and the exhaust port to suppress heat transfer from the exhaust gas to the cylinder head and maintain the temperature of the exhaust gas that flows into an exhaust purification device at a high temperature.

In order to positively attach such a liner to an exhaust port having curves and bends, the liner is divided into an upstream side and a downstream side, and both liners are inserted and attached separately from either an opening end on the upstream side or an opening end on the downstream side of the exhaust port. In the cylinder heads of some engines, the interior ends of the two liners mutually engage to form a continuous channel.

However, if the liner is divided into two parts inserted from the opposite ends of the exhaust port, positively connecting (engaging) the two liners together in the exhaust port is difficult. This is because the liner is positioned with a gap between the inner surface of the exhaust port and the liner, and therefore can easily displace. Thus determining the position of both interior ends of the liners is difficult.

SUMMARY

According to one aspect, a cylinder head for an internal combustion engine includes a combustion chamber recess formed on a lower surface of the cylinder head, an exhaust port with downstream and upstream side channels, a downstream side liner, and an upstream side liner. The downstream side channel has an open end at one side surface of the cylinder head and another end sealed by a bottom wall formed inside the cylinder head. The upstream side channel has an end that opens to the combustion chamber recess and another end connected to a side portion of the downstream side channel. The downstream side liner includes a generally tubular member having a linear axis. The downstream side liner is inserted from the open end of the downstream side channel and is positioned such that an end edge of an insertion end contacts the bottom wall. The downstream side liner includes a connecting hole in a side portion of the liner facing the upstream side channel. The upstream side liner includes a generally tubular member. The upstream side liner is inserted from the end of the upstream side channel that opens to the combustion chamber recess such that the upstream side liner engages with the connecting hole of the downstream side liner.

According to one embodiment, the cylinder head includes a tubular valve guide slidably supporting a stem of a poppet valve that opens and closes the exhaust port. The valve guide is positioned with respect to the cylinder head such that one end of the valve guide protrudes into the downstream side channel. The downstream side liner has a valve guide insertion hole on a side portion of the downstream liner for the valve guide to pass through and a first boss at the valve guide insertion hole protruding into an interior. The upstream side liner has a boss engaging hole engaging the first boss of the downstream side liner.

According to one embodiment, the downstream side liner has a second boss protruding along a peripheral edge of the connecting hole. An outer surface of the upstream side liner contacts an inner peripheral surface of the second boss.

According to one embodiment, an annular valve seat is press fit into the upstream side channel at the end of the upstream side channel that opens to the combustion chamber recess. The upstream side liner is retained by the valve seat.

According to one embodiment, the valve seat has a protruding piece protruding into the upstream side liner at an inner edge of the valve seat. An end portion of the upstream side liner is supported between the protruding piece and the upstream side channel.

According to one embodiment, the upstream side channel has a wide diameter portion having an enlarged diameter forming a step adjacent the end of the upstream side channel that opens to the combustion chamber recess. The upstream side liner has an outward facing flange at a base end of the upstream side liner opposite the insertion end. The flange of the upstream side liner is sandwiched between the valve seat and the step of the upstream side liner.

According to one embodiment, the downstream side liner is closed at the insertion end.

According to one embodiment, a gap is formed between the upstream side liner and the upstream side channel and a gap is formed between the downstream side liner and the downstream side channel.

According to one aspect, a cylinder head includes an exhaust port and first and second liners disposed within the exhaust port. The exhaust port extends between a lower surface of the cylinder head and a side surface of the cylinder head. The second liner has an axis angled with respect to an axis of the first liner to extend transversely with respect to the first liner. The second liner engages the first liner at an opening defined in a side portion of the first liner at a first engagement location.

According to one embodiment, the second liner includes an insertion end extending into an interior of the first liner and the second liner engages the first liner at a second engagement location on the first liner opposite the second liner.

According to one embodiment, at least one of the liners includes a cylindrical wall portion and projections extending circumferentially on the cylindrical wall portion such that the projections contact an inner surface of the exhaust port.

According to another aspect, a liner system for an elongated port of a cylinder head includes first and second liners. The second liner has an axis angled with respect to an axis of the first liner and an insertion end engagingly received by the first liner through an opening in a side portion of the first liner such that the insertion end extends into an interior of the first liner.

DETAILED DESCRIPTION

Figure 1:
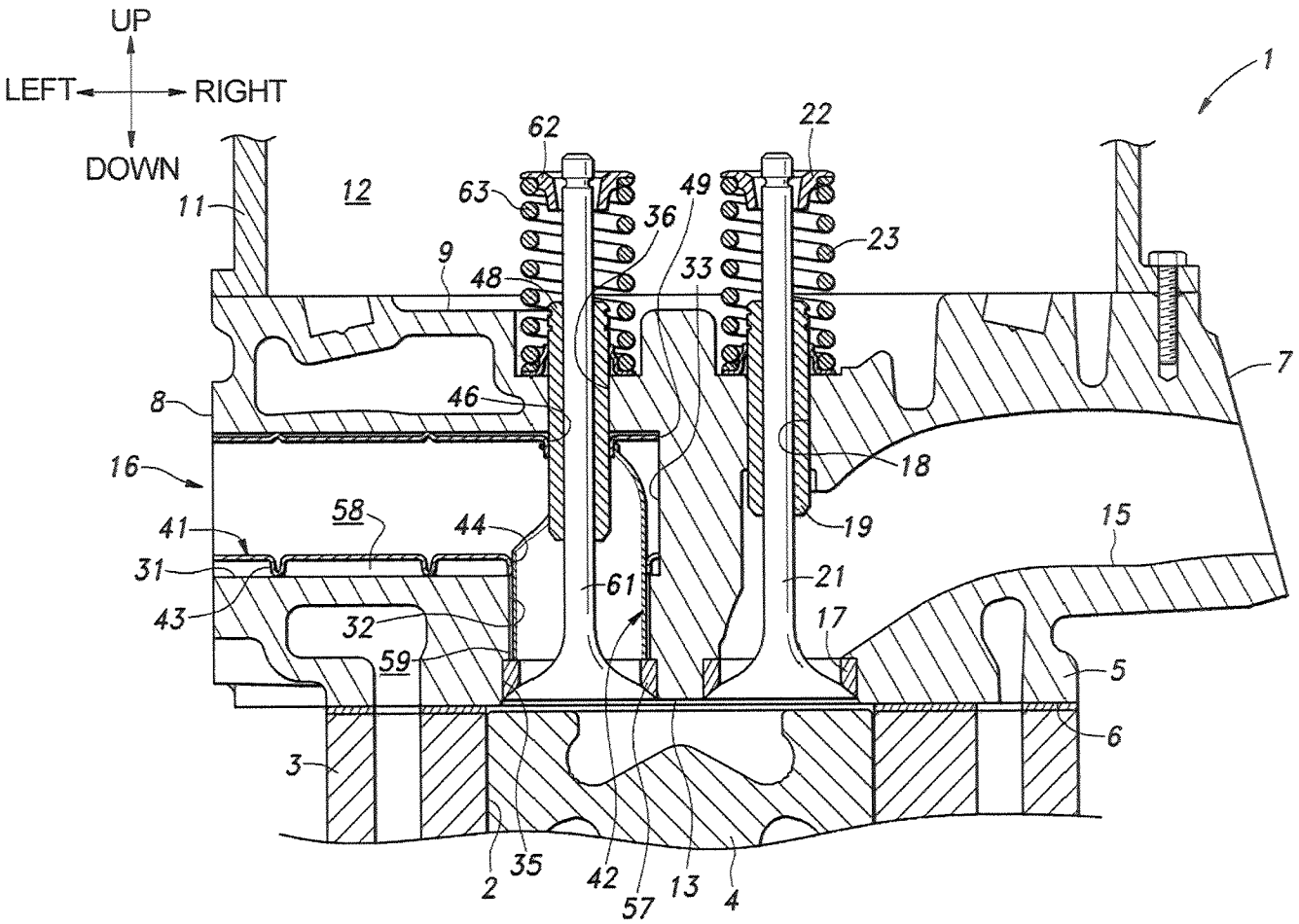
FIG. 1 is a sectional view illustrating an upper part of an engine according to a first embodiment.
Figure 2:
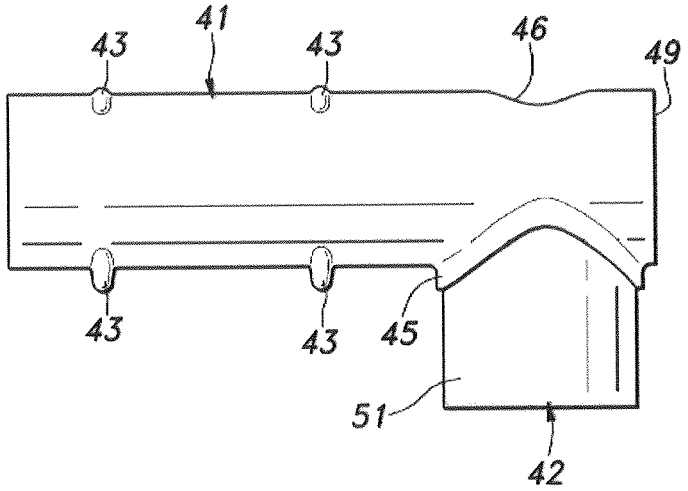
FIG. 2 is a side elevational view illustrating an upstream side liner and a downstream side liner according to the first embodiment.
Figure 3:
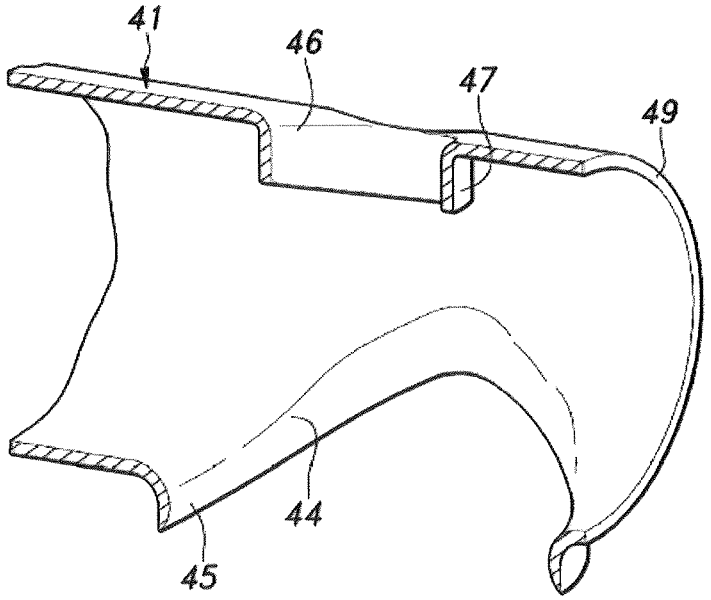
FIG. 3 is a perspective view illustrating a cutaway of the downstream side liner according to the first embodiment.
Figure 4:
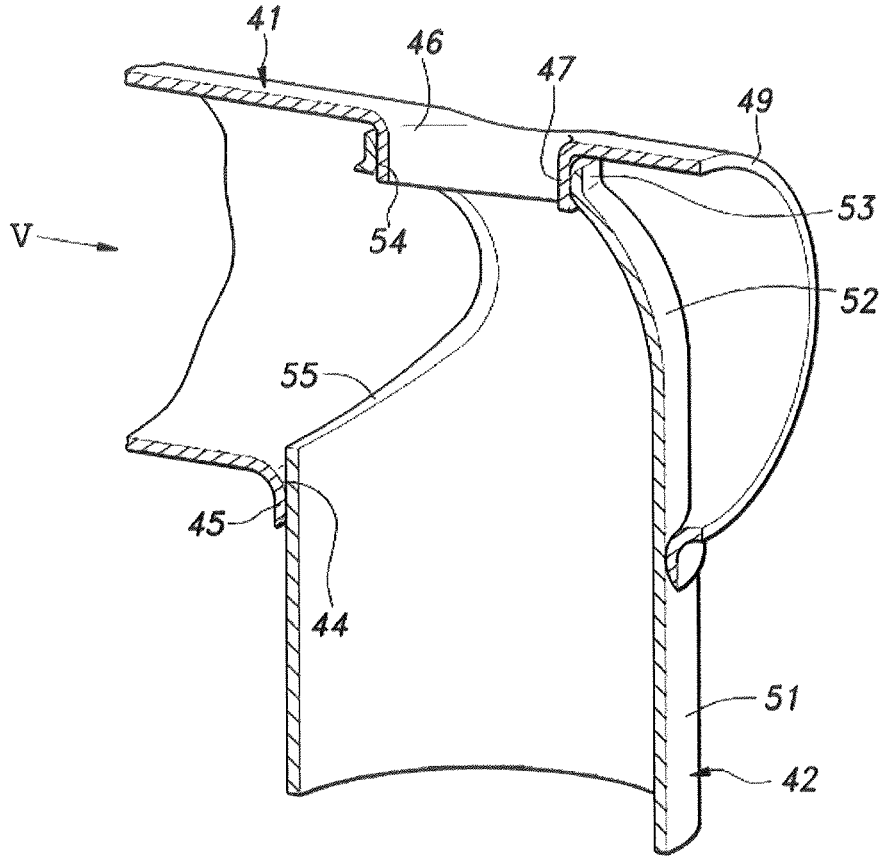
FIG. 4 is a perspective view illustrating a cutaway of the upstream side liner and the downstream side liner according to the first embodiment.
Figure 5:
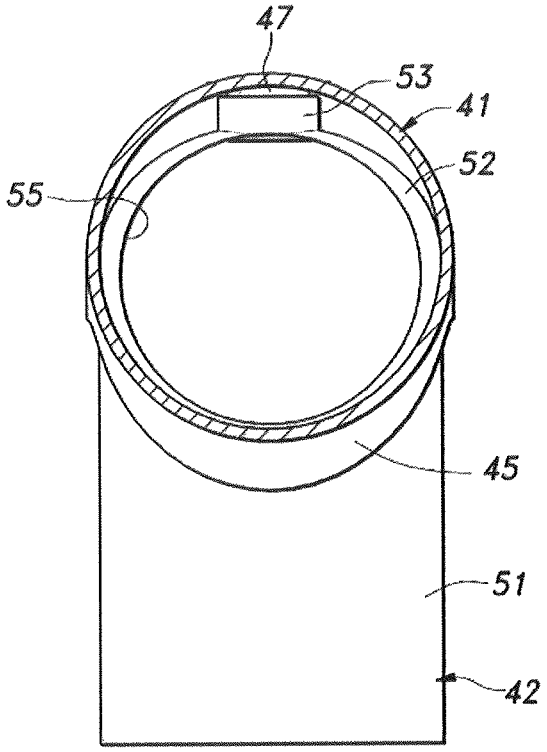
FIG. 5 is a side elevational view as seen from the direction of arrow V in FIG. 4.

Referring to the drawings, there is shown in FIG. 1 an engine 1. According to one embodiment, the engine 1 is a double overhead camshaft (DOHC) type engine. In the following descriptions, directions are determined based on the coordinate axes illustrated in FIG. 1.

As illustrated in FIG. 1, the engine 1 has a cylinder block 3 with a plurality of cylinders 2 provided in a row in a predetermined cylinder row direction. The cylinder 2 has an axis that extends in the vertical direction, and is open on an upper end surface of the cylinder block 3. A piston 4 is slidably contained in the cylinder 2.

The cylinder head 5 is attached to the upper end surface of the cylinder block 3. The cylinder head 5 has a generally rectangular solid shape and can be formed from an aluminum alloy. The cylinder head 5 has a lower end surface 6 providing a joining surface with respect to the cylinder block 3, two end surfaces (not shown) provided in the cylinder row direction, a right side surface 7 and a left side surface 8 provided in a direction orthogonal to the cylinder row direction, and an upper end surface 9 opposite the lower end surface 6. A head cover 11 with a box shape opening downwardly is attached to a peripheral edge of the upper end surface 9 of the cylinder head 5 to cover the upper end surface 9. The upper end surface 9 of the cylinder head 5 defines an operating valve chamber 12 in conjunction with the head cover 11, and forms a bottom surface of the operating valve chamber 12. A combustion chamber recess 13 is recessed upwardly in the lower end surface 6 of the cylinder head 5 at a position corresponding to the cylinder 2.

The cylinder head 5 can have two intake ports 15 (one is illustrated) passing from a right half part of the combustion chamber recess 13 to the right side surface 7, and two exhaust ports 16 (one is illustrated) passing from a left half part of the combustion chamber recess 13 to the left side surface 8.

The intake port 15 has an open end at the combustion chamber recess 13 and curves upwardly and to the right to an open end at the right side surface 7. An intake pipe (not shown) can be attached to the right side surface 7 to connect with the intake port 15. The intake port 15 includes a wide diameter portion adjacent the combustion chamber recess 13. The wide diameter portion has an enlarged diameter forming a step. An annular valve seat 17 is press fit into the wide diameter portion of the intake port 15. A valve hole 18 formed in the cylinder head 5 extends from the intake port 15 to the upper end surface 9 of the cylinder head 5. A tubular (cylindrical) valve guide 19, which is open at both ends, is inserted into the valve hole 18. An intake valve 21, which is illustrated as a poppet valve, includes a stem slidably supported in the valve guide 19. The intake valve 21, which opens and closes the intake port 15, has a valve body that can be seated in the valve seat 17 from the combustion chamber recess 13 side. The intake valve 21 is biased in a closed valve direction (i.e., upwardly in FIG. 1 towards seating of the valve body in the valve seat 17). The intake valve 21 is biased by a disk shaped retainer 22 connected to an end portion of the stem, and a valve spring 23 interposed between the retainer 22 and the upper end surface 9 of the cylinder head 5.

The exhaust port 16 includes a downstream side channel 31 formed by a hole extending in a straight line from the left side surface 8 to a closed bottom and an upstream side channel 32 formed by a hole extending in a straight line from the combustion chamber recess 13 to a side (peripheral) portion of the downstream side channel 31. The downstream side channel 31 is generally round with a substantially uniform diameter and a linear axis, and has a bottom wall 33 in a bottom portion (i.e., a portion opposite the left side surface 8). The upstream side channel 32 is generally round with a substantially uniform diameter and a linear axis extending in the vertical direction, and opens in the side (peripheral) portion of the downstream side channel 31 adjacent the bottom wall 33. In the illustrated cylinder head 5, the downstream and upstream side channels 31, 32 are mutually perpendicular. The upstream side channel 32 has a wide diameter portion 35 adjacent an open end of the channel 32 adjacent the combustion chamber recess 13. The wide diameter portion 35 has an enlarged diameter forming a step. A generally round and substantially linear valve hole 36 extends from an upper side portion of the downstream side channel 31 to the upper end surface 9 of the cylinder head 5. The valve hole 36 and the upstream side channel 32 have axes that are substantially aligned.

The engine 1 includes a downstream side liner 41 and an upstream side liner 42 respectively inserted into the downstream side channel 31 and the upstream side channel 32. The downstream side liner 41 is generally tubular. The liners 41, 42 could be formed from a ferrous metal by hydroforming. The ferrous metal could have a relatively small coefficient of thermal expansion.

As illustrated in FIG. 1 through FIG. 5, the downstream side liner 41 is open at both ends and includes a generally cylindrical wall portion with a substantially uniform diameter and a linear axis. As shown in FIG. 1, an outer diameter of the cylindrical wall portion of the downstream side liner 41 is smaller than an inner diameter of the downstream side channel 31 such that a gap 58 can be provided between the liner 41 and the channel 31. The downstream side liner 41 includes protrusions 43 (see FIG. 2) at spaced locations on upper and lower portions of the liner. The protrusions extend in an outward radial direction from the cylindrical wall portion of the liner 41. Contact between the protrusions 43 and an inner peripheral surface of the downstream side channel 31 (see FIG. 1) helps to position the downstream side liner 41 within the channel 31. The position of the downstream side liner 41 with regard to the downstream side channel 31 is also determined because an end edge 49 of the liner 41 (an insertion end) contacts the bottom wall 33 of the downstream side channel 31. The gap 58 between the cylindrical wall portion of the downstream side liner 41 and the downstream side channel 31, established by the protrusions 43, provides an air layer between the liner 41 and the channel 31.

The downstream side liner 41 includes a connecting hole 44 in a lower side portion of the cylindrical wall of the liner 41 facing the upstream side channel 32. The connecting hole 44 is generally round as seen from above and has a cylindrical boss 45 at a peripheral edge of the hole directed outwardly from liner 41.

The downstream side liner 41 includes a valve guide insertion hole 46 in an upper side portion of the cylindrical wall of the liner 41 facing the valve hole 36. The valve guide insertion hole 46 is generally round as seen from above and has a cylindrical boss 47 at a peripheral edge of the hole directed inwardly to the liner 41. A tubular valve guide 48, which is open at both ends, is press fit into the valve hole 36 of cylinder head 5. A lower end of the valve guide 48 is positioned within an interior of the downstream side liner 41, passing through the valve guide insertion hole 46 and the boss 47 of liner 41. An outer surface of the valve guide 48 can contact an inner surface of the boss 47. Such engagement between the valve guide 48 and the boss 47 functions to connect the downstream side liner 41 to the downstream side channel 31 to more stably maintain the position of the liner 41 within the channel 31.

As illustrated in FIG. 1, FIG. 2, FIG. 4, and FIG. 5, the upstream side liner 42, which is open at both ends, is generally tubular with a rounded cross section and a linear axis. The upstream side liner 42 has a straight pipe part 51 and a constricted part 52. The straight pipe part 51 is cylindrical with a uniform diameter and extends from a base end of the liner 42 to an intermediate portion of the liner. The constricted part 52 continuously tapers in diameter from the intermediate portion of the liner 42 to an insertion end of the liner 42. An outer diameter of the straight pipe part 51 is smaller than an inner diameter of the upstream side channel 32 such that a gap 59 (see FIG. 1) is defined between the liner 42 and the channel 32. The constricted part 52 has a dome shaped curvature that forms a protrusion on an outer surface side. A cylindrical joining boss 53 of substantially uniform diameter is formed coaxially on an end edge of the constricted part 52. An inner peripheral portion of the joining boss 53 defines a round engaging hole 54 at the insertion end of the upstream side liner 42. A channel hole 55 is provided in the constricted part 52 of the upstream side liner 42 to provide communication between an interior of the upstream liner 42 and an interior of the downstream side liner 41 (see FIG. 4).

The upstream side liner 42 is inserted into the downstream side liner 41 through the connecting hole 44 such that the boss 47 of liner 41 engages with the joining boss 53 of liner 42 and the straight pipe part 51 of liner 42 engages with the boss 45 of liner 41. Therefore, the downstream side liner 41 and the upstream side liner 42 mutually engage at first and second engagement locations to determine relative position The upstream side liner 42 is positioned coaxially within the upstream side channel 32 to define the gap 59 therebetween.

As shown in FIG. 1, the channel hole 55 is positioned to face towards a base end of the downstream side liner 41, which is opposite the insertion end edge 49. The constricted part 52 of liner 41 contacts (see FIG. 5) an inner peripheral surface of the downstream side liner 41 in a lower portion of the downstream side liner 41. As shown, the channel hole 55 is shaped such that the majority of the peripheral edge part thereof is positioned within the contacting portions between the downstream side liner 41 and the constricted part 52 of upstream side liner 42.

An annular valve seat 57 is press fit into the wide diameter portion 35 of the upstream side channel 32. The valve seat 57 can be formed from a material having a relatively low thermal conductivity. The valve seat 57 is formed such that an inner diameter of the valve seat is smaller than an inner diameter of the upstream side channel 32 and the inner portion of the valve seat protrudes into the upstream side channel 32 in the radial direction. The upstream side liner 42 is supported by the valve seat 57 because of contact between a base end edge of the liner 42 an end surface of the valve seat 57 facing the upstream side channel 32.

As illustrated in FIG. 1, an exhaust valve 61, illustrated as a poppet valve, includes a stem slidably supported in the valve guide 48. The exhaust valve 61, which opens and closes the exhaust port 16, has a valve body that can be seated in the valve seat 57 from the combustion chamber recess 13 side. The exhaust valve 61 is biased in a closed valve direction (i.e., upwardly in FIG. 1 towards seating of the valve body in the valve seat 57). The exhaust valve 61 is biased by a disk shaped retainer 62 connected to an end portion of the stem and a valve spring 63 interposed between the retainer 62 and the upper end surface 9 of cylinder head 5. An exhaust pipe (not shown) can be attached to the left side surface 8 to connect with the exhaust port 16. A catalytic converter (not shown) can be connected to the exhaust pipe.

The procedure for placing the downstream side liner 41 and the upstream side liner 42 within the cylinder head 5 is described below. The placement procedures described below are performed prior to attaching the cylinder block 3 (and an exhaust pipe) to the cylinder head 5. Initially, the downstream side liner 41 is inserted from the left side surface 8 into the open end of the downstream side channel 31 (insertion end first). The amount of insertion of the downstream side liner 41 can be ensured because of contact between the end edge 49 of liner 41 and the bottom wall 33 of the downstream side channel 31. Next, the downstream side liner 41 is rotationally positioned within the channel 31 such that the connecting hole 44 faces the upstream side channel 32 (i.e., downwardly) and the valve guide insertion hole 46 faces the valve hole 36 (i.e., upwardly). The downstream side liner 41 is positioned laterally (i.e., radially) within the downstream side channel 31 because of the contact between the protrusions 43 and the inner surface of the downstream side channel 31.

Next, the valve guide 48 is inserted into the cylinder head 5 such that the valve guide 48 is received by the valve hole 36, valve guide insertion hole 46, and the boss 47 to extend into the interior of the downstream side liner 41. The connection between the downstream side liner 41 and the valve guide 48, which is also connected to the cylinder head 5, functions to connect the downstream side liner 41 to the cylinder head 5.

The upstream side liner 42 is then inserted from the combustion chamber recess 13 into the upstream side channel 32 (insertion end first). The joining boss 53 and the constricted part 52 of the upstream side liner 42 pass through the connecting hole 44 of the downstream side liner 41. The straight pipe part 51 of liner 42 engages the connecting hole 44 of liner 41 and the joining boss 53 of liner 42 engages with the boss 47 of liner 41 (i.e., the downstream and upstream side liners 41, 42 are engaged to each other at the first and second engagement locations). At this time, the upstream side liner 42 is rotationally positioned within the upstream side channel 32 such that the channel hole 55 faces the base end of the downstream side channel 31 (i.e., towards the left-hand surface 8 of cylinder head 5).

Next, the valve seat 57 is press fit into the wide diameter portion 35 of upstream side channel 32. As discussed above (and shown in FIG. 1), the base end edge of the upstream side liner 42 contacts the end surface of the valve seat 57. Configured in this manner, the valve seat 57 functions as a retainer preventing the upstream side liner 42 from detaching from the downstream side liner 41 and the upstream side channel 32. At this point, the connection between the downstream side liner 41 and the upstream side liner 42 and the connection between the liners 41, 42 and the cylinder head 5 is completed.

It should be understood that the insertion procedure could be modified such that the step of inserting the upstream side liner 42 into the upstream side channel 32 is performed prior to the step of inserting the valve guide 48 into the cylinder head 5.

In the first embodiment, the end edge 49 of the downstream side liner 41 contacts the bottom wall 33 of the downstream side channel 31 for stable positioning of the liner 41 with regard to the cylinder head 5. The engagement between the valve guide 48 and downstream side liner 31 also helps to orient and maintain the position of the liner 31 within the downstream side channel 31. This construction facilitates relatively easy engagement of the upstream side liner 42 with the bosses 45, 47 of the downstream side liner 41. Furthermore, the downstream side liner 41 and the upstream side liner 42 can easily be inserted into the downstream side channel 31 and the upstream side channel 32 because the respective axes are aligned linearly.

As described above, the upstream side liner 42 is received by the downstream side liner 41 through the connecting hole 44 formed in a side portion of the downstream side liner 41. Arranged in this manner, the direction of insertion and removal of the downstream side liner 41 with respect to the cylinder head 5 differs from the direction of insertion and removal of the upstream side liner 42 Therefore, when the upstream side liner 42 is inserted into the cylinder head 5, the previously-inserted downstream side liner 41 will not easily move in the direction of removal for the liner 41. In particular, the downstream side liner 41 will not move following the insertion of the upstream side liner 42 because the downstream side liner 41 and the upstream side liner 42 intersect each other.

As also discussed above, the downstream side liner 41 and the upstream side liner 42 are engaged to each other at two engagement locations (i.e., at a first engagement location between the straight pipe part 51 and the connecting hole 44 and a second engagement location between the joining boss 53 and the boss 47). This engagement ensures that the relative positions of the liner 41, 42 are stable. Furthermore, in an embodiment in which the valve seat 57 retaining the upstream side liner 42 is formed from a material with low thermal conductivity, the transfer of heat from the upstream side liner 42 to the cylinder head 5 through the valve seat 57 is suppressed.

Figure 6:
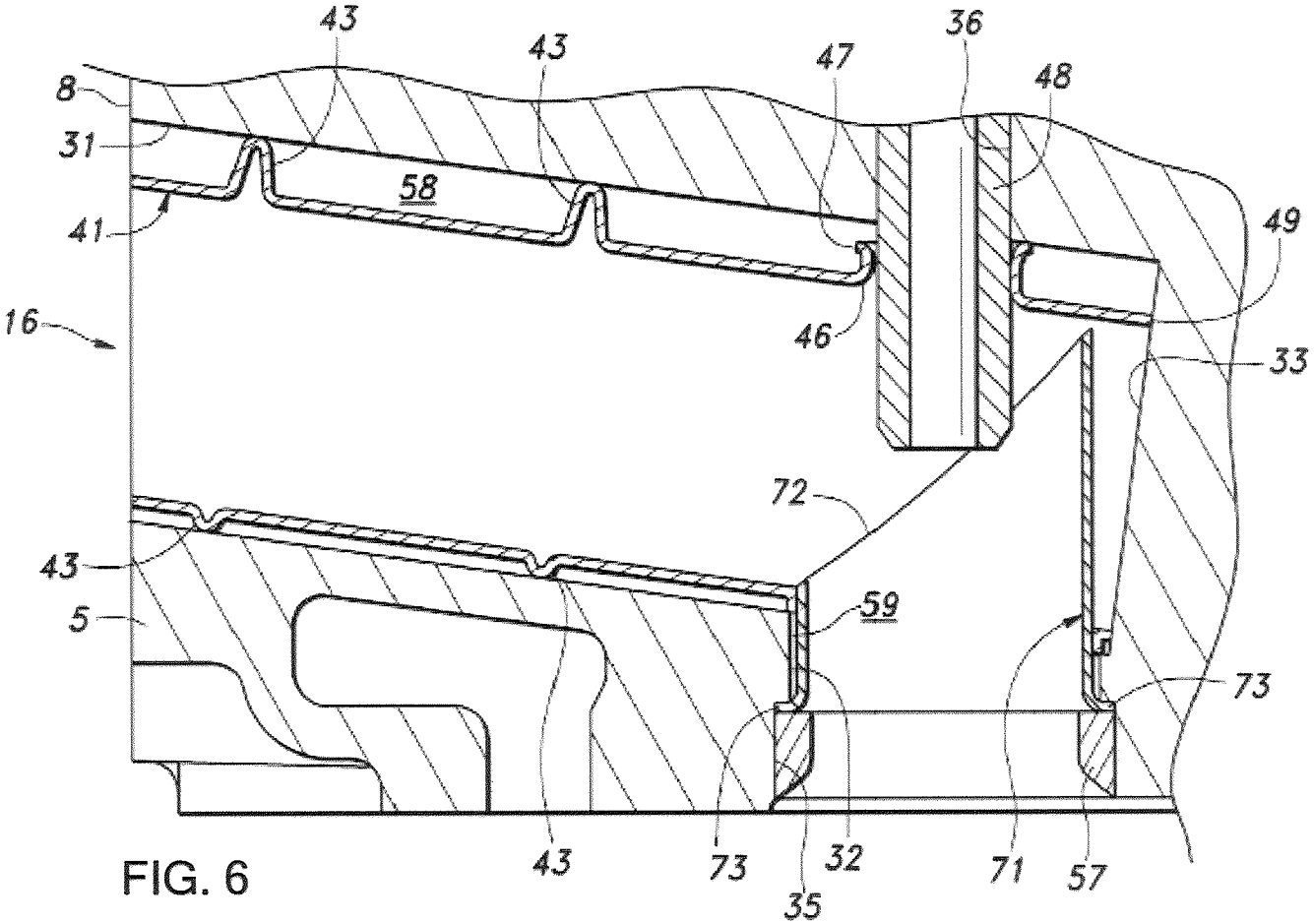
FIG. 6 is a sectional view illustrating a cylinder head according to a second embodiment.
Figure 7:
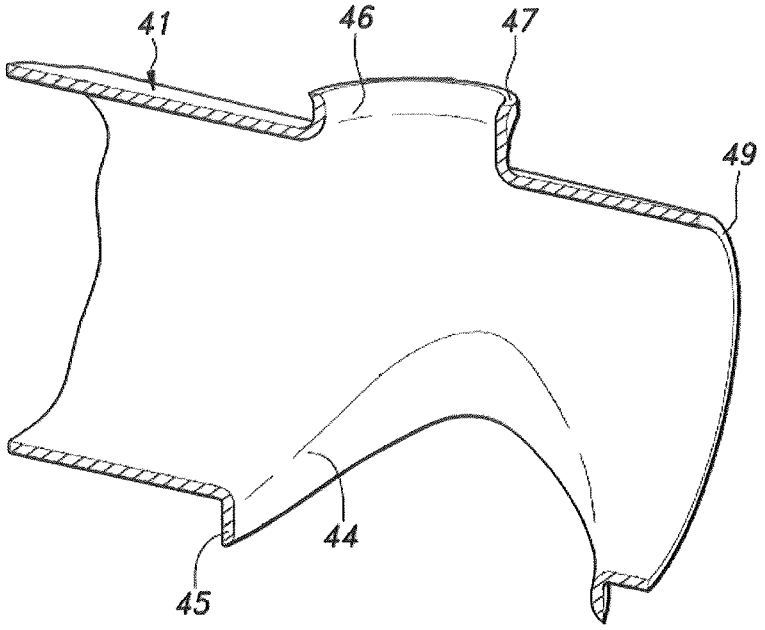
FIG. 7 is a perspective view illustrating a cutaway of a downstream side liner according to the second embodiment.
Figure 8:
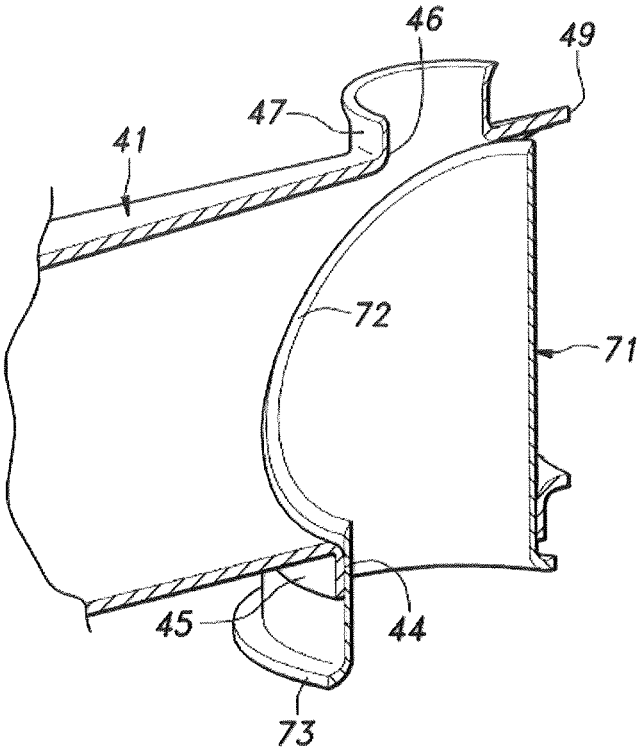
FIG. 8 is a perspective view illustrating a cutaway of an upstream side liner and the downstream side liner according to the second embodiment.

Referring to FIG. 6 through FIG. 8, a cylinder head 5 according to a second embodiment is shown. The downstream side channel 31 of the exhaust port 16 extends at an angle with regard to a virtual plane that is orthogonal to the cylinder axis (i.e., the channel 31 is angled with respect to the horizontal). The upstream side channel 32 of the second embodiment, similar to that of the first embodiment, extends in the vertical direction. Arranged in this manner, the downstream side channel 31 and the upstream side channel 32 are connected to each other at an oblique angle larger than 90°. The downstream side channel 31 and the upstream side channel 32 can be connected to each other at a desired angle.

Referring to FIG. 7, which illustrates the downstream side liner 41 according to the second embodiment. As shown, the boss 47 of the downstream side liner 41 extends outwardly from the valve guide insertion hole 46 formed in the cylindrical wall portion of liner 41. This differs from the first embodiment (see FIG. 3) in which the boss 47 extends inwardly. As illustrated in FIG. 6 and FIG. 8, the upstream side liner 71 of the second embodiment includes a straight cylindrical pipe portion having an end edge at an insertion end thereof formed in a plane inclined with regard to the plane orthogonal to an axis of the pipe portion (i.e., a plane oblique to the axis of the pipe portion). An opening 72 formed at the insertion end of the upstream side liner 71 forms an ellipsoid shape. An axis orthogonal to the opening surface is inclined approximately 45° with regard to the axis of the pipe portion. The upstream side liner 71 is inserted into the connecting hole 44 of the downstream liner 41 (insertion end first) such that the pipe portion of liner 71 engages the connecting hole 44. As shown in FIG. 6, the opening 72 is located within an interior of the downstream side liner 41, and is positioned to face upwardly and towards the left side surface 8 of the cylinder head 5. A portion of a lower end of the valve guide 48 passes through the opening 72 such that the portion is positioned within an interior of the upstream side liner 71.

The upstream side liner 71 includes an outwardly facing flange 73 formed on a base end edge of the liner 71. The flange 73 is dimensioned to extend within the wide diameter portion 35 of the upstream side channel 32. Arranged in this manner, the flange 73 is sandwiched (i.e., captured) between the step, which is formed at the interface between the wide diameter portion 35 and the upstream side channel 32, and the valve seat 57, which is press fit into the wide diameter portion 35.

The structure of the upstream side liner 71 of the second embodiment is simplified such that insertion of the liner 71 is facilitated. Furthermore, the sandwiching (capture) of flange 73 of liner 71 between the valve seat 57 and the step of channel 32 functions to positively retain the liner 71 in the cylinder head 5.

Figure 9:
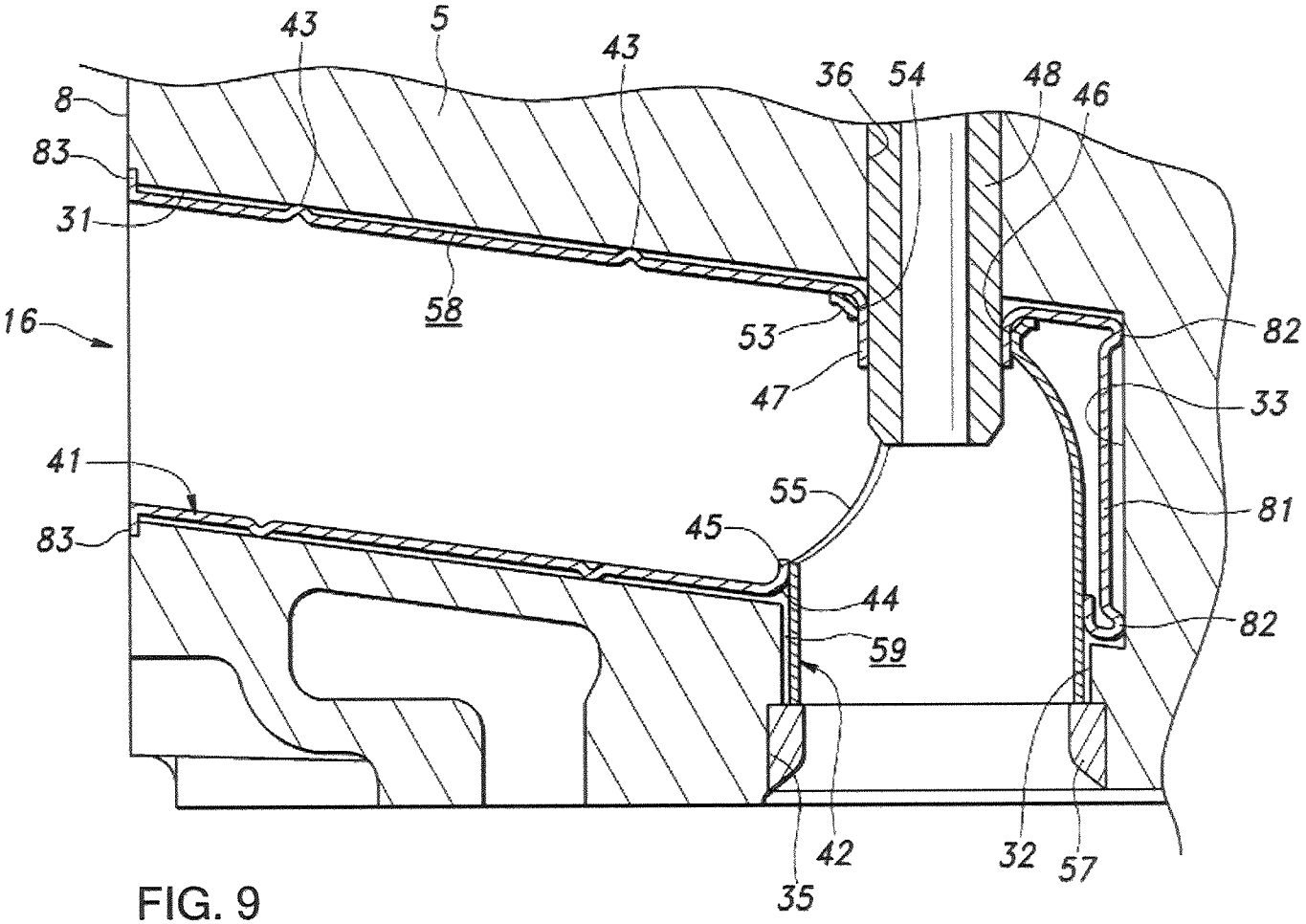
FIG. 9 is a sectional view illustrating a cylinder head according to a third embodiment.

Referring to FIG. 9, there is shown a cylinder head 5 according to a third embodiment including a downstream side liner 41 and an upstream side liner 42. Similar to the first embodiment, the third embodiment includes bosses 45, 47 and 53 providing engagement between the liners 41, 42 at two locations. The downstream side liner 41 of the third embodiment includes a bottom plate 81 that closes the insertion end of the liner 41. A protrusion 82 formed about a periphery of the bottom plate 81 contacts the bottom wall 33 of the downstream side channel 31.

The closure of the insertion end of the downstream side liner 41 by the bottom plate 81 prevents exhaust gas circulating through the downstream side liner 41 from contacting the bottom wall 33, thereby suppressing transfer of heat from the exhaust gas to the cylinder head 5. Furthermore, contact between the bottom plate 81 and the bottom wall 33 is limited to the protrusion 82, such that transfer of heat from the bottom plate 81 to the bottom wall 33 is suppressed. The bottom plate 81 is illustrated with a generally flat plate portion. The shape of bottom plate, however, could vary to include a curved or spherical portion (e.g., to smoothly continue into a side portion of the downstream side liner 41 for smoothing the flow of exhaust gas within the downstream side liner 41).

The downstream side liner 41 of the third embodiment includes an outwardly extending flange 83 at a base end of the liner 41. The flange 83 is retained at the opening end peripheral edge of the downstream side channel 31 (e.g., in a wide diameter portion of the channel 31 adjacent the left side surface 8) to fix the position of the downstream side liner 41 in channel 31. Moreover, the flange 83 can be sandwiched between the opening end peripheral edge of the downstream side channel 31 and an exhaust pipe (not shown).

Figure 10:
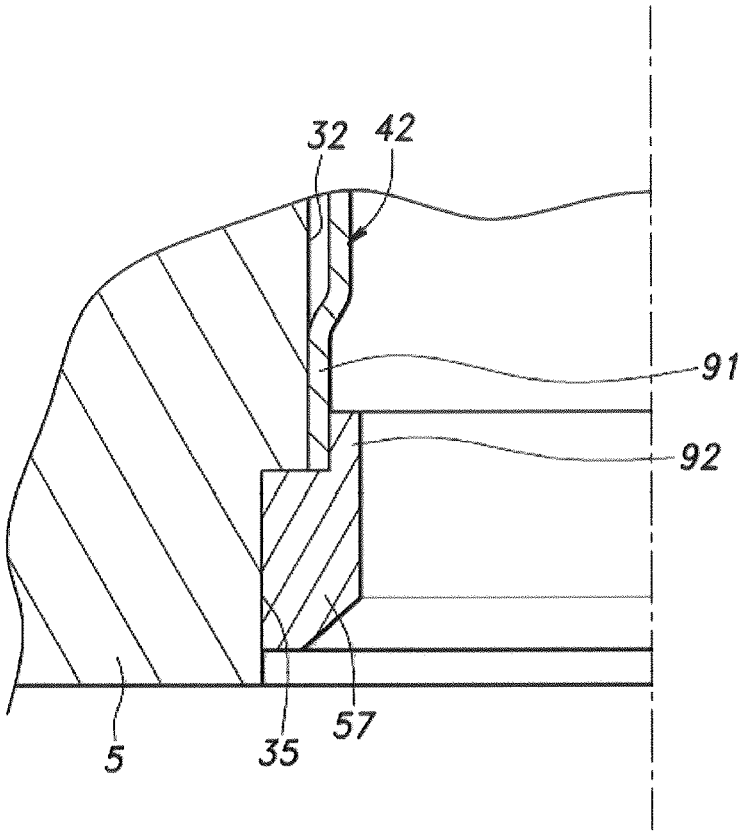
FIG. 10 is a sectional view illustrating a support structure of the upstream side liner according to a modified embodiment.

A modified version of an upstream portion of the exhaust port is shown in FIG. 10. The upstream side liner 42 includes a locking structure at the base end of the liner. A base end portion 91 of the upstream side liner 42 has an enlarged diameter such that an outer peripheral surface of the liner 42 contacts an inner peripheral surface of the upstream side channel 32. The valve seat 57 includes a protruding piece 92 extending axially from an end of the valve seat that faces the upstream side liner 42 (i.e., a downstream end of the valve seat 57 opposite the combustion chamber). As shown, the protruding piece 92 extends from an inner peripheral portion of the valve seat 57 (i.e., at an inner diameter) such that the protruding piece 92 sandwiches the base end edge 91 of the upstream side liner 42 against the inner peripheral surface of the upstream side channel 32. Arranged in this manner, the modified valve seat 57 prevents the upstream side liner 42 from moving downwardly (i.e., in a removal direction) and also prevents movement of the liner 42 in a radial direction.

The above description of the specific embodiments is hereby complete, but the present invention is not restricted to the aforementioned embodiments, and a broad range of alternate embodiments are possible. For example, the upstream side channel 32 could be curved in an arc and the upstream side liner 42 correspondingly curved. Furthermore, the cross sectional shapes of the downstream side channel 31 and the upstream side channel 32 could be varied as desired (e.g., an ellipsoidal or square shape). Furthermore, the cross-sectional area of the downstream side channel 31 could increase from the bottom wall 33 towards the open end at the left side surface 8. Similarly, a cross-sectional area of the upstream side channel 32 could gradually increase from the connection between the channels 31, 32 towards the combustion chamber recess 13. The forms of the downstream side liner 41 and the upstream side liner 42 could be changed to match the shapes of the downstream side channel 31 and the upstream side channel 32.

What is claimed is:

1. A cylinder head for an internal combustion engine comprising:

a combustion chamber recess formed on a lower surface of the cylinder head;

an exhaust port including a downstream side channel and an upstream side channel, the downstream side channel having an open end at a side surface of the cylinder head and another end sealed by a bottom wall formed inside the cylinder head, the upstream side channel including an end that opens to the combustion chamber recess and another end connected to a side portion of the downstream side channel;

a downstream side liner including a generally tubular member having a linear axis and inserted from the open end of the downstream side channel and positioned such that an edge of an insertion end of the downstream side liner abuts the bottom wall, the downstream side liner having a connecting hole in a side portion facing the upstream side channel; and an upstream side liner including a generally tubular member and inserted from the end of the upstream side channel that opens to the combustion chamber recess such that the upstream side liner engages with the connecting hole of the downstream side liner.

2. The cylinder head according to claim 1, further comprising a tubular valve guide slidably supporting a stem of a poppet valve that opens and closes the exhaust port, the valve guide positioned with respect to the cylinder head such that one end of the valve guide protrudes into the downstream side channel, the downstream side liner including a valve guide insertion hole on a side portion of the downstream liner for the valve guide to pass through, and a first boss at the valve guide insertion hole protruding into an interior of the downstream side liner, the upstream side liner including a boss engaging hole that engages with the first boss of the downstream side liner.

3. The cylinder head according to claim 2, wherein the downstream side liner includes a second boss that protrudes along a peripheral edge of the connecting hole, and an outer surface of the upstream side liner contacts with an inner peripheral surface of the second boss.

4. The cylinder head according to claim 1, wherein the upstream side liner has a linear axis.

5. The cylinder head according to claim 1, wherein an annular valve seat is press fit into the upstream side channel at the end of the upstream side channel that opens to the combustion chamber recess such that the upstream side liner is retained by the valve seat.

6. The cylinder head according to claim 5, wherein the valve seat includes a protruding piece protruding into the upstream side channel at an inner edge of the valve seat, and an end portion of the upstream side liner is supported between the protruding piece and the upstream side channel.

7. The cylinder head according to claim 5, wherein the upstream side channel includes a wide diameter portion having an enlarged diameter forming a step adjacent the end of the upstream side channel that opens to the combustion chamber recess, the upstream side liner including an outward facing flange at a base end of the upstream side liner opposite the insertion end, the flange of the upstream side liner being sandwiched between the valve seat and the step of the upstream side channel.

8. The cylinder head according to claim 1, wherein the downstream side liner is closed at the insertion end of the liner.

9. The cylinder head according to claim 1, wherein a gap is formed between the upstream side liner and the upstream side channel and a gap is formed between the downstream side liner and the downstream side channel.

10. A cylinder head comprising:

an exhaust port extending between a lower surface of the cylinder head and a side surface of the cylinder head; and first and second liners disposed within the exhaust port, the second liner having an axis angled with respect to an axis of the first liner to extend transversely with respect to the first liner, the second liner engaging the first liner at an opening defined in a side portion of the first liner at a first engagement location.

11. The cylinder head according to claim 10, wherein the second liner includes an insertion end extending into an interior of the first liner.

12. The cylinder head according to claim 11, wherein the second liner also engages the first liner at a second engagement location on the first liner opposite the first engagement location.

13. The cylinder head according to claim 12, further comprising an elongated valve guide slidingly receiving an exhaust valve, the valve guide extending through an opening defined in the first liner at the second engagement location, the insertion end of the second liner engaging a boss included on the first liner adjacent the opening at the second engagement location.

14. The cylinder head according to claim 11, wherein the insertion end of the second liner includes an opening in a side portion to facilitate communication between an interior of the second liner and the interior of the first liner.

15. The cylinder head according to claim 11, further comprising a valve seat received in the exhaust port adjacent the lower surface of the cylinder head, the valve seat contacting a base end of the second liner opposite the insertion end to retain the second liner within the exhaust port.

16. The cylinder head according to claim 15, wherein a portion of the second liner adjacent the base end is captured between valve seat and the exhaust port.

17. The cylinder head according to claim 10, wherein a gap is defined between an outer surface of each of the liners and an inner surface of the exhaust port.

18. The cylinder head according to claim 17, wherein at least one of the liners includes a cylindrical wall portion and projections extending circumferentially on the cylindrical wall portion such that the projections contact the inner surface of the exhaust port.

19. A liner system for an elongated port of a cylinder head, the liner system including:

a first substantially cylindrical liner having an axis and first and second openings located on diametrically opposite sides of the first liner; and a second liner having an axis angled with respect to the axis of the first liner, the second liner having an insertion end portion engagingly received by the first liner through the first opening, the insertion end portion of the second liner extending through an interior of the first liner and engaging the second opening.

20. The liner system according to claim 19, wherein the insertion end portion of the second liner includes an aperture in a side wall of the second liner providing communication between the interior of the first liner and an interior of the second liner.

* * * * *